United States Patent [19]

Shimizu et al.

[11] 4,123,199

[45] Oct. 31, 1978

[54] ROTOR-SHAFT ASSEMBLY

[75] Inventors: Syogo Shimizu, Chigasaki; Toshihiko Ochiai; Masato Sakai, both of Yokohama, all of Japan

[73] Assignee: Tokyo Shibaura Electric Co., Ltd., Kawasaki, Japan

[21] Appl. No.: 781,417

[22] Filed: Mar. 25, 1977

[30] Foreign Application Priority Data

Mar. 31, 1976 [JP] Japan ..... 51-34416

[51] Int. Cl.[2] ..... F01D 5/34; F01D 5/06

[52] U.S. Cl. ..... 416/244 A; 416/198 A; 416/214 A; 416/241 B

[58] Field of Search ..... 416/198 A, 241 B, 244 A, 416/214 A

[56] References Cited

U.S. PATENT DOCUMENTS

| | | | |
|---|---|---|---|
| 2,479,057 | 8/1949 | Bodger | 416/241 B X |
| 2,769,611 | 11/1956 | Schwarzkopf | 416/198 A X |
| 3,745,628 | 7/1973 | Stahl | 416/198 A X |
| 3,916,495 | 11/1975 | Klassen et al. | 416/198 A X |
| 3,943,703 | 3/1976 | Kronogard | 416/214 A |
| 3,999,376 | 12/1976 | Jeryan et al. | 416/241 B X |
| 4,011,737 | 3/1977 | Kruger et al. | 416/241 B X |

FOREIGN PATENT DOCUMENTS

| | | | |
|---|---|---|---|
| 458,863 | 8/1949 | Canada | 416/198 A |
| 902,004 | 8/1945 | France | 416/198 A |
| 735,504 | 5/1943 | Fed. Rep. of Germany | 416/241 B |
| 225,640 | 5/1943 | Switzerland | 416/198 A |

*Primary Examiner*—Everette A. Powell, Jr.

*Attorney, Agent, or Firm*—Cushman, Darby & Cushman

[57] ABSTRACT

A rotor-shaft assembly comprising a ceramic turbine rotor, a metal shaft and a metal connector disposed between the rotor and the shaft. The metal connector is fixed to the rotor by some suitable means and coupled with the metal shaft by mutual engagement of teeth provided at the ends of the connector and the shaft.

7 Claims, 2 Drawing Figures

ROTOR-SHAFT ASSEMBLY

BACKGROUND OF THE INVENTION

I. Field of the Invention

This invention relates to a rotor-shaft assembly, and more particularly to such assembly suitable for use in a gas turbine.

II. Description of the Prior Art

Presently, gas turbines are widely used as one of heat engines in various field. As a means for improving the efficiency of the gas turbine, it has been attempted to use ceramics having a high heat resistance and a high mechanical strength for making a turbine rotor. For example, a turbine rotor made of sintered silicon nilride has been developed recently and come to be used in gas turbines for an automobile and for other fields of industries.

A turbine rotor is joined to a shaft and rotated at a high speed within a turbine. A ceramic turbine rotor is intended to enable a turbine to operate at high temperatures. Generally, the circumferential edge portion of the ceramic turbine rotor is exposed to high temperatures which an ordinary heat-resistant metal is incapable of withstanding, for example, to a temperature of 1,200° C. However, the central portion of the rotor is not so heated, rendering it possible to join the ceramic turbine rotor directly to a metal shaft.

An interesting technique of joining a ceramic turbine rotor to a metal shaft, which is under development, is reported on page 24 of a book "Ceramics for High Performance Applications" published in 1974. Specifically, an attempt to join these two members by a so-called "curvic coupling" is reported in the book. The curvic coupling is a face spline and necessitates a particular machining of high precision.

It is not desirable to apply machining of this kind to a ceramic rotor, because the machining of ceramics is very difficult compared with the machining of metal. In addition, if a machining error has taken place, the stress is concentrated onto the erroneously machined portion during the rotation of the rotor, leading to breakage of the rotor. Further, the machining error makes the rotor itself nonusable in some cases, resulting in a low yield of the rotor.

SUMMARY OF THE INVENTION

An object of this invention is to provide a rotor-shaft assembly in which a ceramic turbine rotor is joined to a metal shaft without machining the ceramic rotor or with the machining of the ceramic rotor held at a minimum level.

The rotor-shaft assembly according to this invention comprises a ceramic turbine rotor; a connector member comprising a columnar or cylindrical body of metal having first and second ends, the first end being co-axially joined to the ceramic turbine rotor; and a metal shaft co-axially joined to the second end of the connector member by mutual engagement of teeth provided at the ends of the connector member and the metal shaft.

DETAILED DESCRIPTION OF THE PREFERRED EMBODIMENTS

Figure 1:
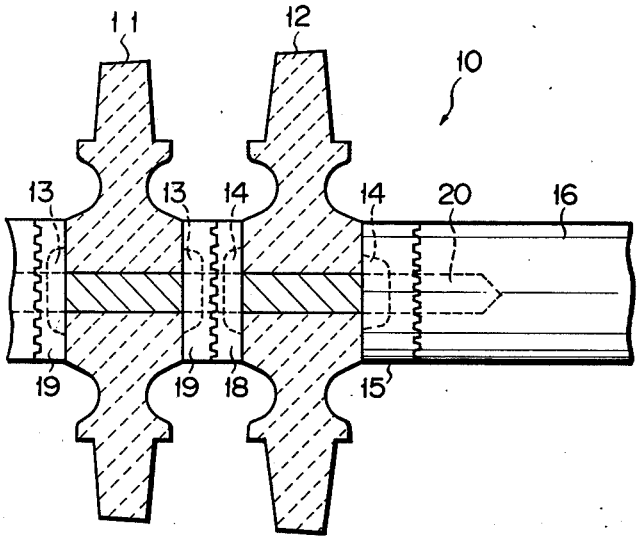
FIG. 1 is a cross sectional view showing a part of a rotor-shaft assembly according to one embodiment of this invention.

This invention will be more fully described with reference to the appended drawings in which the same reference numerals denote the same parts or members.

FIG. 1 shows a rotor-shaft assembly 10 according to this invention. It is seen that the assembly 10 comprises two-stage turbine rotors. Each of the first-stage rotor 11 and the second stage rotor 12 is formed of a ceramic disc. Truncated cone portions 13, 13 horizontally project in opposite directions from the central portion of the rotor 11. Likewise, truncated cone portions 14, 14 project from the central portion of the rotor 12. These truncated cone portions are co-axial with the rotors. A turbine rotor of this type can be prepared by sintering powdered ceramics such as silicon nitride or silicon carbide. The sintering can easily be achieved by, for example, hot pressing. A material having a formula "$Si_{6-z}Al_zN_{8-z}O_z$ ($O<Z\leqq 4.2$) may also be used for forming the turbine rotor (SIALON turbine rotor). The SIALON turbine rotor may be prepared by pressurizing a mixture of silica, alumina, aluminum nitride and silicon nitride at a temperature within the range of from 1,200° C. to 2,000° C.

The second-stage rotor 12 is co-axially joined via a connector member 15 to a shaft 16 made of a heat-resistant metal or alloy, for example, chromium-molybdenum steel or inconel alloy (composition: Cr 11 to 15%; Ni>70%; Mn<1.0%; Fe<1.0%; Si<0.5%; C<0.15%). The connector member 15 is a cylindrical or a columnar body made of a heat-resistant metal similar to that which provides the shaft 16.

Figure 2:
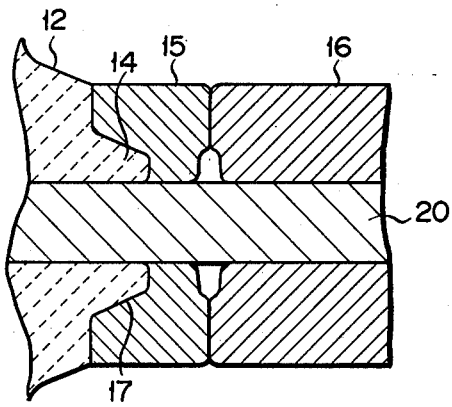
FIG. 2 is a partial magnification of FIG. 1

As best shown in FIG. 2, a groove 17 is provided on one side-face of the connector member. The groove 17 is mated with the truncated cone portion 14 of the rotor 12. In general, the mating is carried out by inserting the truncated cone portion 14 into the groove 17 under pressure. It is convenient to utilize a so-called "thermal insertion" in that step because the resultant mating is enabled to be free from loosening during the operation of the turbine. Otherwise, the loosening is likely to be caused by the heat to which the mated portion is exposed during the operation because of difference in thermal expansion coefficient between the connector member 15 and the rotor 12. Referring to the thermal insertion, the connector member 15 is heated to a temperature equal to or slightly higher than the temperature to which the connector member is exposed during the operation of the turbine. The truncated cone portion 14 is then forced into the groove 17 of the heated connector member, followed by cooling.

The connector member 15 and the shaft 16 are joined to each other by teeth coupling, for example, a so-called "curvic coupling". As is well known to those skilled in the art, the curvic coupling is a face spline, and refers to toothed connection members with the teeth spaced circumferentially about the face and with teeth which have a characteristic curved shape when viewed in a plane perpendicular to the coupling axis. This curvature exists because the members are machined with a face-mill cutter or a cup-type grinding wheel. One member is made with the outside edge of the cutter or wheel, and a concave, or an hour glass shaped tooth is produced. The mating member is usually cut or ground with the inside edge, thus producing a convex, or barrel-shaped tooth. The radius of the cutter or the grinding wheel surface is chosen in such a way that the teeth will either mate along the full face width of the tooth, or along only a section of the face width, as desired.

As described previously, it is not desired to apply such a complicated precision machining to the ceramic rotor. In this invention, however, this precision machining is applied to the metal connector member disposed between the ceramic rotor and the metal shaft. It should also be noted that turbine rotors produced are further subjected to machining for ensuring a good balance during the rotation thereof. The rotor-shaft assembly according to this invention is advantageous in this respect, too, because the machining for the balancing purpose can also be applied to the connector member made of metal, not to the ceramic rotor.

FIG. 1 shows that connector members 18, 19 similar to the metal connector member 15 are mounted between the first-stage rotor 11 and second-stage rotor 12. These rotors 11 and 12 are joined by the curvic coupling of the connector members 18 and 19. Further, an attachment bolt 20 is provided along the common axis of the rotors 11, 12 and the shaft 16 so as to fix the assembly.

As described in detail, the rotor-shaft assembly according to this invention comprises a metal connector member mounted between the ceramic rotor and the metal shaft, rendering it possible to join the rotor to the shaft without machining the ceramic rotor. In view of the difficulty and undesirability of machining the ceramic rotor, this invention produces prominent advantages in the manufacture of the rotor-shaft assembly.

What we claim is:

1. A rotor-shaft assembly comprising:

a ceramic turbine rotor;

a connector member comprising a columnar or cylindrical body of metal having first and second ends, the first end being co-axially joined to the ceramic turbine rotor; and a metal shaft co-axially joined to the second end of the connector member by mutual engagement of teeth provided at the ends of the connector member and the metal shaft.

2. The rotor-shaft assembly according to claim 1, wherein the ceramic turbine rotor is provided with a projection integral and co-axial with the rotor and the first end of the connector member is coupled with the projection.

3. The rotor-shaft assembly according to claim 2, wherein the projection of the rotor is of a truncated cone shape.

4. The rotor-shaft assembly according to claim 3, wherein the first end of the connector member is provided with a groove and the truncated cone-shaped projection of the rotor is coupled with the groove by thermal insertion.

5. The rotor-shaft assembly according to claim 4, wherein the turbine rotor is made of silicon nitride, silicon carbide or SIALON.

6. The rotor-shaft assembly according to claim 4, wherein the connector member and the shaft are each made of a heat-resistant metal.

7. The rotor-shaft assembly according to claim 6, wherein the heat-resistant metal is chromium-molybdenum steel.

* * * * *